US006375500B1

(12) United States Patent
Murakami et al.

(10) Patent No.: US 6,375,500 B1
(45) Date of Patent: Apr. 23, 2002

(54) WATER PROOF CONNECTOR HAVING A SEAL CONFIRMATION ACCESS WINDOW

(75) Inventors: Takao Murakami; Yuiti Ito; Masaru Fukuda, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/591,674

(22) Filed: Jun. 12, 2000

(30) Foreign Application Priority Data

Jun. 10, 1999 (JP) ..... 11-164150

(51) Int. Cl.[7] ..... H01R 13/40

(52) U.S. Cl. ..... 439/587; 439/196; 439/206; 439/274; 439/589

(58) Field of Search ..... 439/587, 196, 439/206, 205, 274, 275, 279, 589

(56) References Cited

U.S. PATENT DOCUMENTS

| | | | | |
|---|---|---|---|---|
| 3,077,572 A | | 2/1963 | Zimmerman | |
| 4,614,390 A | | 9/1986 | Baker | |
| 4,802,867 A | * | 2/1989 | Palmer | 439/587 |
| 6,179,657 B1 | * | 1/2001 | Murakami et al. | 439/587 |

FOREIGN PATENT DOCUMENTS

| | | | |
|---|---|---|---|
| EP | 0 335 721 A | 3/1989 | H01R/13/523 |
| JP | 11-329571 | 11/1999 | |
| JP | 11-354200 | 12/1999 | |

OTHER PUBLICATIONS

Patent Abstract of Japan, 11354200, Dec. 24, 1999.

* cited by examiner

*Primary Examiner*—Tho D. Ta
*Assistant Examiner*—Truc Nguyen
(74) *Attorney, Agent, or Firm*—Sughrue Mion, PLLC

(57) ABSTRACT

A waterproof rubber plug has a through hole through which an electric wire is inserted to be connected to a terminal. A connector housing includes a terminal chamber for accommodating the terminal and a wall portion having a through hole formed so as to oppose to the terminal chamber, through which the electric wire is inserted. A recess for accommodating the rubber plug to thereby seal the electric wire and the terminal chamber. The recess is formed on an inner side face of the wall portion of the connector housing so as to communicate with the through hole of the wall portion. A window hole is formed on a part of the wall portion surrounding the recess so as to expose an anti-sealing part of the rubber plug accommodated in the recess.

8 Claims, 13 Drawing Sheets

WATER PROOF CONNECTOR HAVING A SEAL CONFIRMATION ACCESS WINDOW

BACKGROUND OF THE INVENTION

The present invention relates to a small-size multi-way waterproof connector in which waterproofing property between a connector housing and a plurality of electric wires connected with terminals is improved.

A related waterproof connector, which is disclosed in Japanese Patent Publication No. 11-329571 will be explained with reference to FIGS. 7 to 9E. A connector housing 11 of the waterproof connector 10" consists of an inner housing 12 formed of a synthetic resin and including a plurality of terminal chambers 13 integrally formed therewith, an outer. housing 17 formed of a synthetic resin into which the inner housing 12 is adapted to be inserted, and a spacer 28 interposed between the inner housing 12 and the outer housing 13 in order to hold female terminals 14 contained in the above described terminal chambers 13 respectively.

As shown in FIGS. 7 and 8, the inner housing 12 has a box-like portion 12*a* of which an upper and a lower faces are open at their rearward ends. The above described terminal chambers 13 are formed in a space defined by a central horizontal wall 12*b* and vertical side walls 12*c* which also serve as partition walls. The female terminals 14 are adapted to be contained in the terminal chambers 13 respectively. The box-like portion 12*a* is integrally formed with projecting engagement claws 15 at opposite sides and a center of its upper and lower faces. Flange portions 16 are integrally formed so as to project from both sides of the box-like portion 12*a* at a center of its front face. Moreover, the front wall of the box-like portion 12*a* is provided with rectangular through holes 12*d* at positions corresponding to the terminal chambers 13, into which male terminals of a mating connector (not shown) are adapted to be inserted. Further, each of the female terminals 14 has a pair of press-connection blades 14*b* which are bent from plate portions at both sides in the rear of a box-like portion 14*a*.

As shown in FIGS. 7 and 8, the outer housing 17 is in a form of double boxes which are open at the front face, consisting of an inner wall portion 17*a* in a shape of substantially rectangular column, an outer wall portion 17*b* in a shape of substantially rectangular column enclosing the inner wall portion 17*a,* and a bottom wall portion (one wall portion) 17*c* connecting the inner and the outer wall portions 17*a,* 17*b* at their rear parts. A central part of the bottom wall portion 17*c* is formed as a thick wall portion. In front of the thick wall portion are provided rubber plug chambers 19 each having a larger diameter and a circular cross section and in which waterproof rubber plugs 18 are contained by press-fitting or the like, at positions facing with the terminal chambers 13. In the back of the thick wall portion are formed electric wire through holes 21 each having a smaller diameter and a circular cross section and through which electric wires 20 are adapted to pass so as to communicate with the corresponding rubber plug chambers 19. Each of the waterproof rubber plugs 18 is substantially in a form of a cylinder having undulations at both inner and outer peripheral faces, so that the electric wire 20 is adapted to pass therethrough without clearance.

At front opposite sides of the upper and lower walls of the inner wall portion 17*a* of the outer housing 17, are respectively provided rectangular slits 22 for engaging and disengaging with the engagement claws 15 which are formed at the opposite sides of the upper and lower faces of the box-like portion 12*a* of the inner housing 12. At the front center of the upper and lower walls of the inner wall portion 17*a* is provided rectangular longer locking slits 23 for engaging and disengaging with the engagement claws 15 formed at the center of the upper and lower faces of the box-like portion 12*a* of the inner housing 12. Moreover, in a depth of the outer face of the inner wall portion 17*a* of the outer housing 17, is integrally formed a V-shaped packing receiving portion 25 in a projecting manner which is adapted to receive an annular waterproof packing 24 formed of rubber. Tapered faces 26 are respectively provided at front edges of the inner faces of the inner wall portion 17*a* at positions facing with the locking slits 22 and 23. Further, the upper and lower walls of the outer wall portion 17*b* of the outer housing 17 are respectively provided in their forward parts with locking holes 27 for engaging and disengaging with flexible locking arms of the mating connector (not shown).

As shown in FIGS. 7 and 8, the spacer 28 is in a form of a box which opens at the front face, consisting of a body portion 28*a* in a shape of substantially rectangular column adapted to be fitted to the inner face of the inner wall portion 17*a* of the outer housing 17, a flange portion 28*b* in a shape of substantially rectangular column which is integrally formed with the body portion 28*a* so as to be bent backwardly from the front end thereof and adapted to be fitted to the outer face of the inner wall portion 17*a* of the outer housing 17, and a bottom wall portion 28*c* of the body portion 28*a*.

The box-like portion 12*a* of the inner housing 12 is adapted to be inserted into the body portion 28*a* of the spacer 28. At inner faces of the upper and lower walls of the body portion 28*a* of the spacer 28, are integrally provided rib-like projections 29 for preventing detachment of the terminals which are adapted to engage with a rear end edge of the box-like portion 12*a* of the inner housing 12 and rear end edges of the box-like portions 14*a* of the female terminals 14 which are contained in the respective terminal chambers 13.

In the front of the connected portion between the body portion 28*a* and the flange portion 28*b* of the spacer 28 are provided notches 30, 31 respectively at positions corresponding to the engagement claws 15 and the flange portions 16 of the inner housing 12. At outer faces of the upper and lower walls of the body portion 28*a* of the spacer 28 between the vertically arranged notches 30 are integrally formed engagement claws 32 for engaging and disengaging with the locking slits 23 in the outer housing 17. Moreover, a distal end of the flange portion 28*b* of the spacer 28 is in such a form that it holds the packing 24 engaged in the packing receiving portion 25 in the inner wall portion 17*a* of the outer housing 17 when the spacer has been inserted in the outer housing 17.

The bottom wall portion 28*c* of the spacer 28 is formed with electric wire through holes 33 at positions corresponding to the respective electric wire through holes 21 in the outer housing 17. The bottom wall portion 28*c* of the spacer 28 serves to hold the rubber plugs 18 which are inserted into the respective rubber plug chambers 19 in the bottom wall portion 17*c* of the outer housing 17, when the spacer has been fitted into the outer housing 17. The electric wires 20 passed through the electric wire through hole 21 in the outer housing 17, the rubber plugs 18, and the electric wire through holes 33 in the spacer 28 are press-connected between a pair of the press-connection blades 14*b* of the female terminals 14 contained in the terminal chambers 13 in the inner housing 12. The terminal chambers 13 and the electric wires 20 are sealed with the rubber plugs 18 and the packing 24 respectively.

In order to assemble the above structured waterproof connector 10", the rubber plugs 18 are first inserted in a fitting direction of the connector housing into the respective rubber plug chambers 19 inside the bottom wall portion 17*c* of the outer housing 17 which constitutes the exterior of the connector housing 11, and set as shown in FIG. 9A. Then, the packing 24 is inserted and set in the packing receiving portion 25 in the inner wall 17*a* of the outer housing 17.

After that, the body portion 28*a* of the spacer 28 is inserted into the inner wall portion 17*a* of the outer housing 17 as shown in FIG. 9B, and the engagement claws 32 in the body portion 28*a* of the spacer 28 are locked in the respective locking slits 23 formed in the inner wall portion 17*a* of the outer housing 17. This locking action of the engagement claws 32 of the body portion 28*a* of the spacer 28 with the respective locking slits 23 in the inner wall portion 17*a* of the outer housing 17 will prevent withdrawal of the rubber plugs 18 in cooperation with the bottom wall portion 17c of the outer housing 17, and at the same time, withdrawal of the packing 24 in cooperation with the slanted distal end of the flange portion 28*b* of the spacer 28. Thus, the waterproofing property of the whole connector housing can be remarkably enhanced.

Next, as shown in FIG. 9C, the electric wires 20 are inserted from the electric wire through holes 21 in the bottom wall portion 17*c* of the outer housing 17 to pass through the rubber plugs 18 and the electric wire through holes 33 in the bottom wall portion 28*c* of the spacer 28 from the exterior. Then, as shown in FIG. 9D, the electric wires 20 are press-connected to a pair of the press-connection blades 14*b* of the female terminals 14 contained in the terminal chambers 13 in the inner housing 12 which constitutes the interior of the connector housing 11.

Next, as shown in FIG. 9E, the inner housing 12 is inserted into the body portion 28*a* of the spacer 28, and the engagement claws 15 of the box-like portion 12*a* of the inner housing 12 are locked in the locking slits 23 in the inner wall portion 17*a* of the outer housing 17, thereby completing the assembly of the waterproof connector 10". On this occasion, because the rear end edge of the box-like portion 12*a* of the inner housing 12 and the rear end edges of the 1box-like portions 14*a* of the female terminals 14 are respectively locked by the projections 29 which project from the inner faces of the upper and lower walls of the body portion 28*a* of the spacer 28, and the projections 29 will not be deformed outwardly, the female terminals 14 can be surely prevented from withdrawing from the respective terminal chambers 13. Moreover, as the female terminals 14 and the rubber plugs 18 can be held by the spacer 28 at the same time, those components exclusively for preventing the withdrawal of the rubber plugs are not necessary, and accordingly, the components can be reduced in number thereby enabling a low cost production to be attained. In addition, the spacer 28 can be double locked by both the engagement of its own engagement claws 32 with the locking slits 23 in the outer housing 17 and the engagement of the engagement claws 15 in the inner housing 12 with the locking slits 23 in the outer housing 17. Therefore, the withdrawal of the rubber plugs 18 and the packing 24 can be surely prevented, and reliability in the waterproofness can be remarkably improved.

However, in the related waterproof connector 10", the rubber plugs 18 are covered with the bottom wall portion 17*c* of the outer housing 17 and the peripheral wall portion 17*d* around the rubber plug chambers 19 in a completely enclosed state, and therefore, it has been difficult to confirm from the exterior whether or not the rubber plugs 18 are provided in the rubber plug chambers 19 (lack of components) in assembling the waterproof connector 100". Moreover, as shown in FIG. 10, water intruded from the electric wire insertion inlets outside the electric wire through holes 21 in the outer housing 17 has been liable to stay in spaces S respectively formed between the rubber plug chambers 19 in the outer housing 17 and one ends 18*a* of the rubber plugs. 18. There has been a fear that in case where this water thus staying is frozen, the bottom wall portion 17*c* and the peripheral wall portion 17*d* of the outer housing 17 formed of a hard synthetic resin may be broken because they cannot absorb a volume expansion when the water thus staying is frozen into ice.

SUMMARY OF THE INVENTION

Therefore, the invention has been made to solve the above described problems, and it is an object of the invention to provide a multi-way connector in which the presence of the rubber plugs can be easily confirmed to improve assembling grade, and water which has intruded into the rubber plug chambers from the electric wire insertion inlets outside the electric wire through holes in the connector housing can be easily drained, thereby to reliably prevent the peripheral wall portion, etc. from being broken due to freezing of the water.

In order to achieve the above object, according to the present invention, there is provided a waterproof connector comprising:

a waterproof rubber plug having a through hole through which an electric wire is inserted to be connected to a terminal;

a connector housing including a terminal chamber for accommodating the terminal and a wall portion having a through hole formed so as to oppose to the terminal chamber, through which the electric wire is inserted;

a recess for accommodating the rubber plug to thereby seal the electric wire and the terminal chamber, the recess formed on an inner side face of the wall portion of the connector housing so as to communicate with the through hole of the wall portion; and a window hole formed on a part of the wall portion surrounding the recess so as to expose an anti-sealing part of the rubber plug accommodated in the recess.

According to the above configuration, the presence of the rubber plug can be confirmed from the exterior of the connector housing through the window hole, and the assembling grade can be enhanced. Moreover, the water intruded into the recess through the through holes in the connector housing will be drained through the window hole to the exterior and will not stay in the recess, and therefore, the wall portion, etc. will not be broken on occasion of freezing.

Preferably, a diameter of one end portion of the rubber plug which faces inside of the connector housing is reduced to extend outside of the recess, and a diameter of one end portion of the rubber plug which faces outside of the connector housing is reduced as the anti-sealing part.

According to the above configuration, the one end of the rubber plug can be easily observed from the exterior of the connector housing through the window hole. With this structure, the presence of the rubber plug can be easily confirmed, and the assembling grade can be remarkably enhanced.

Preferably, the window hole is formed so as to bore through the portion of the wall portion surrounding the recess in the vertical direction, and so as to extend up to a position adjacent to a portion where the through hole of the wall portion is provided.

According to the above configuration, the presence of the rubber plug can be more certainly confirmed from the exterior of the connector housing through the window hole, and the assembling grade can be enhanced. Moreover, the water intruded into the recess through the through holes in the connector housing will be more certainly drained through the window hole to the exterior and will not stay in the recess, and therefore, the wall portion, etc. will not be broken on occasion of freezing.

Preferably, the connector housing includes an inner housing having the terminal chamber and an outer housing having sidewalls for defining a chamber together with the wall portion, into which the inner housing is fitted.

According to the above configuration, the presence of the rubber plug can be very easily confirmed through the window hole from the exterior of the outer housing, even in case where the recess are provided in the wall portion of the outer housing in a plurality of rows both in a vertical and lateral directions. Further, the water which has intruded into the recess through the through hole in the outer housing can be smoothly and reliably drained through the lower portion of the window holes, and the damages of the wall portion, etc. on occasion of freezing can be surely avoided.

DETAILED DESCRIPTION OF THE PREFERRED EMBODIMENTS

Now, embodiments according to the invention will be described by way of examples referring to the accompanying drawings.

Figure 1:
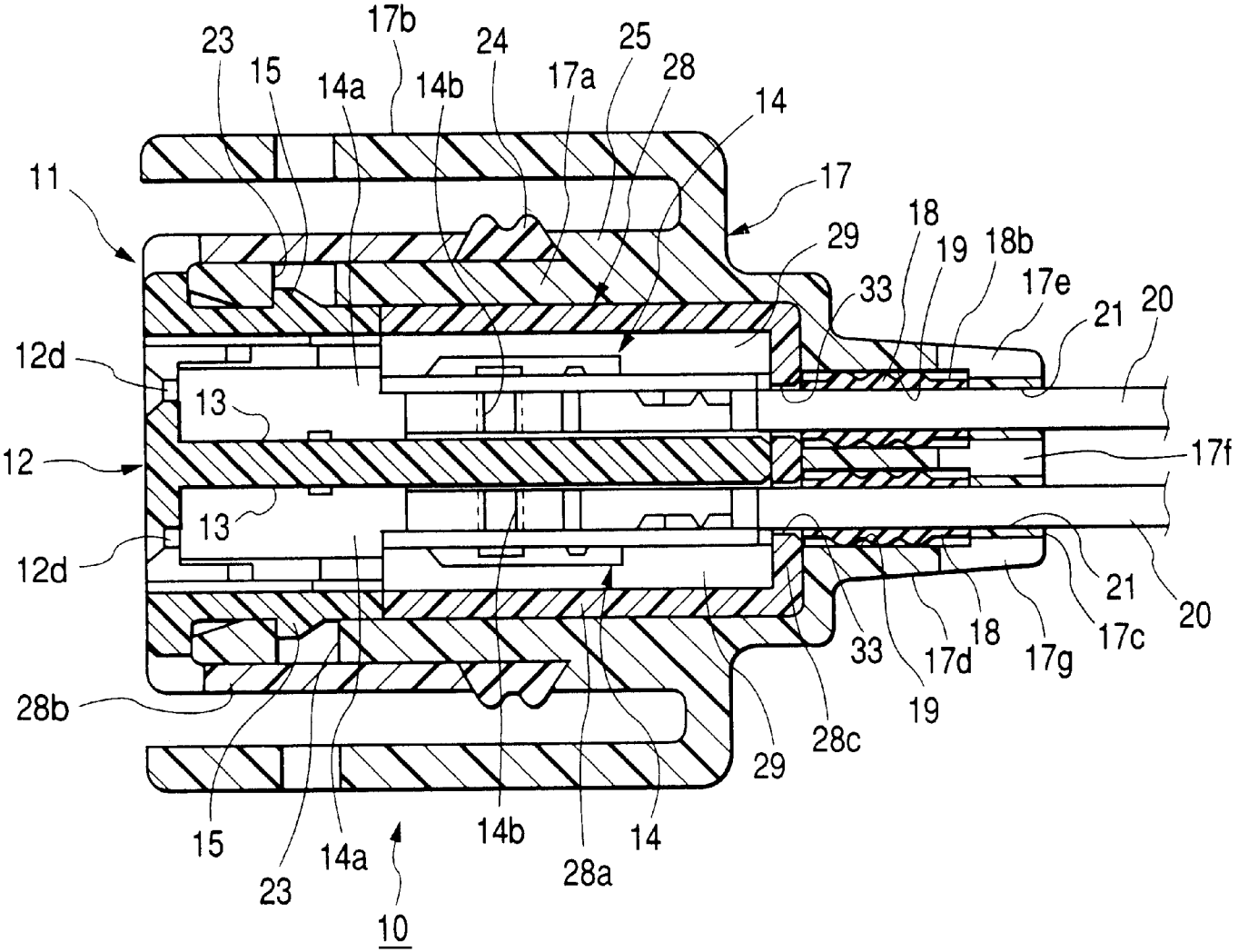
FIG. 1 is a sectional view showing a waterproof connector according to a first embodiment of the invention in a completely assembled state.
Figure 2:
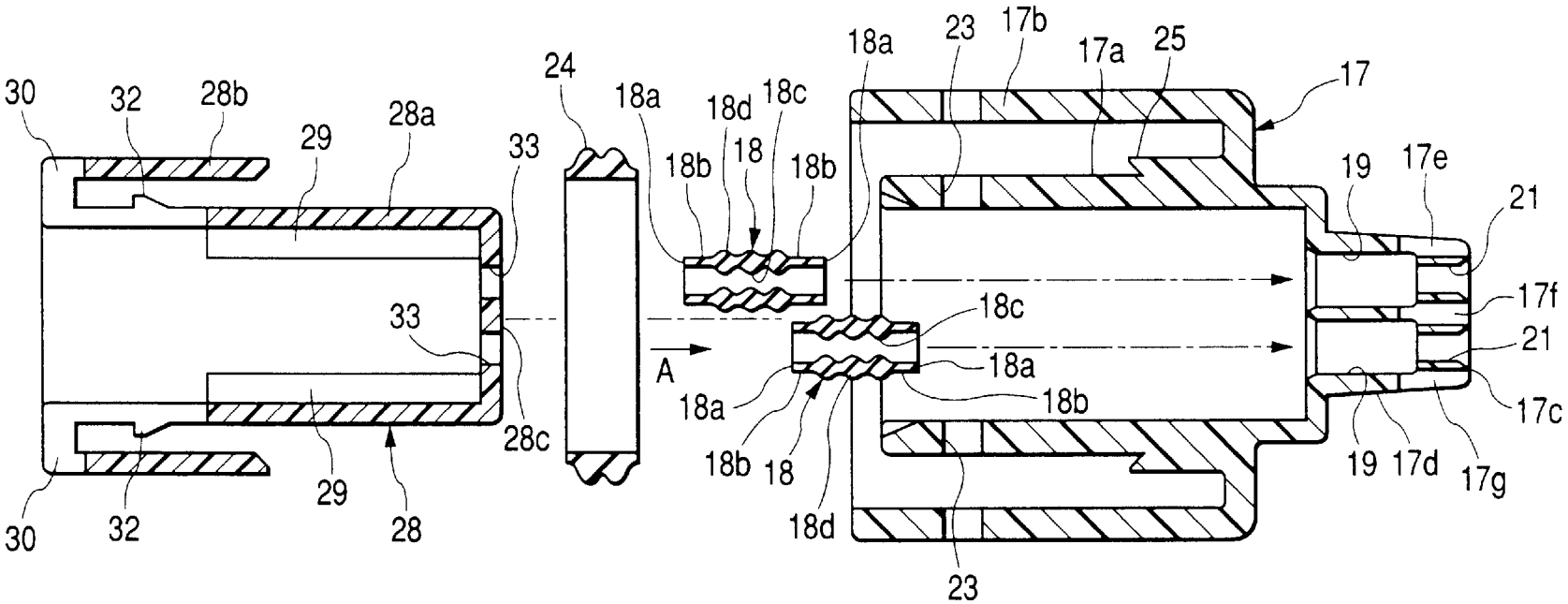
FIG. 2 is a sectional view showing the above waterproof connector in a state before assembled.
Figure 3:
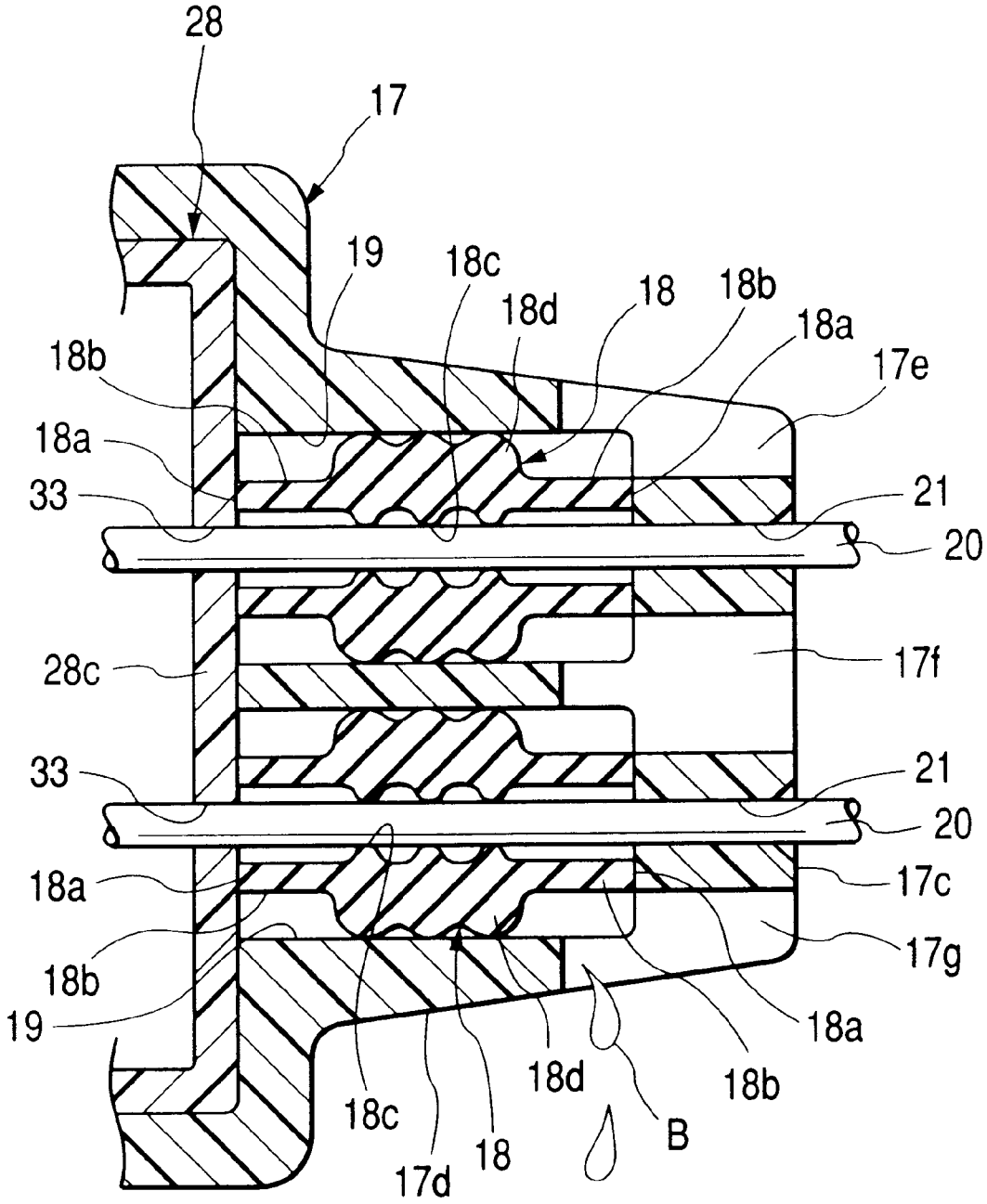
FIG. 3 is a sectional view of the essential part of the above waterproof connector.
Figure 4:
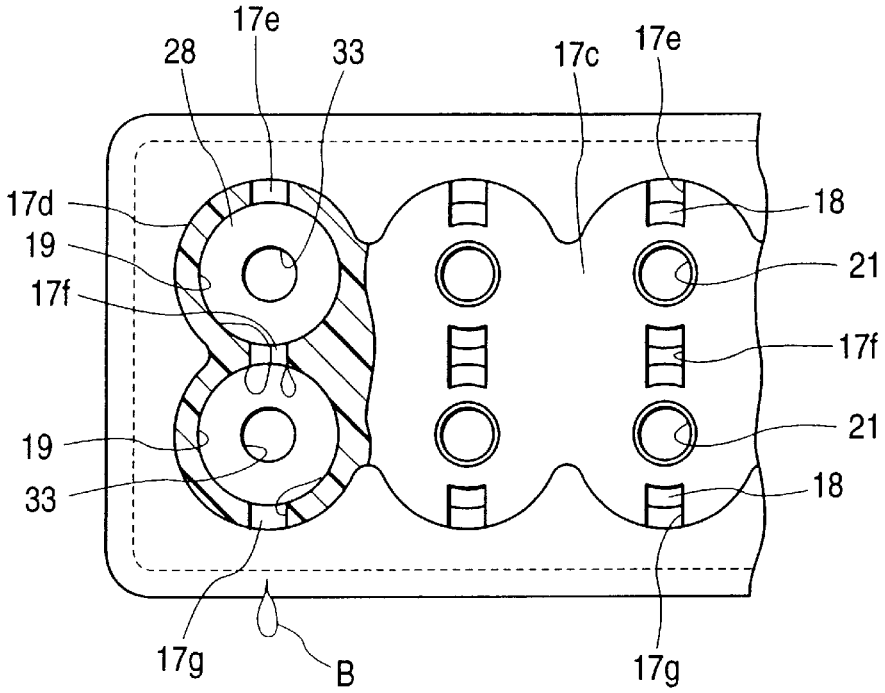
FIG. 4 is a fragmentary rear view partly shown in section of the essential part of the above waterproof connector.
Figure 5:
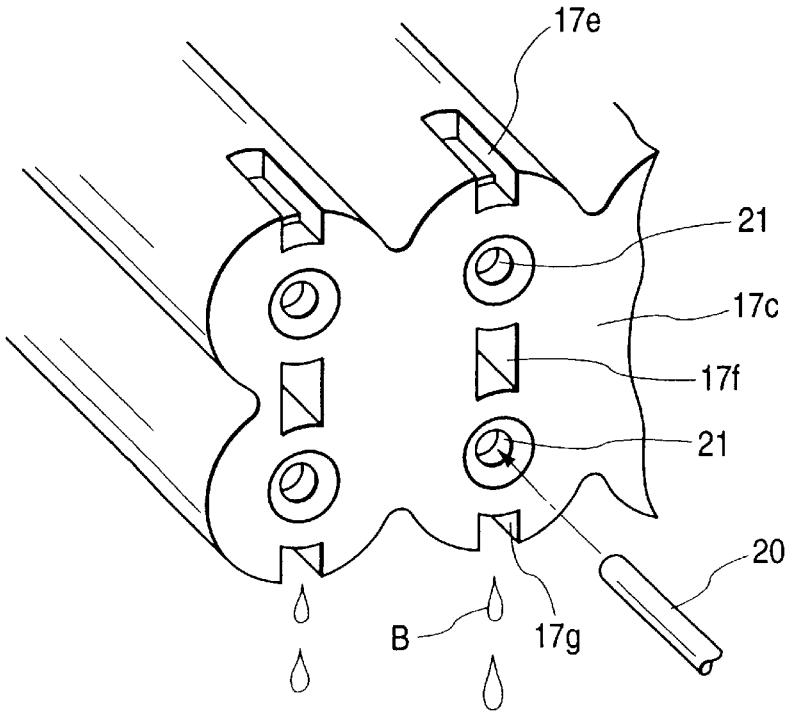
FIG. 5 is a fragmentary perspective view of the essential part of the above waterproof connector.

FIG. 1 is a sectional view showing a waterproof connector according to a first embodiment of the invention in a completely assembled state, FIG. 2 is a sectional view showing the waterproof connector in a state before assembled, FIG. 3 is a sectional view of the essential part of the waterproof connector, FIG. 4 is a fragmentary rear view of the essential part partly shown in section, and FIG. 5 is a fragmentary perspective view of the essential part.

As shown in FIG. 1, as well as the related waterproof connector, a connector housing 11 of the waterproof connector 10 consists of an inner housing 12 formed of a synthetic resin and including a plurality of terminal chambers 13 integrally formed therewith and arranged both in vertical and lateral directions, an outer housing 17 formed of a synthetic resin into which the inner housing 12 is adapted to be inserted, and a spacer 28 interposed between the inner housing 12 and the outer housing 17 in order to hold female terminals 14 contained in the above described terminal chambers 13 respectively.

As shown in FIGS. 1 to 3, the electric wire through holes 21 are formed in the bottom wall portion 17*c* of the outer housing 17 at the positions facing with the terminal chambers 13 respectively, and the rubber plug chambers 19 are formed inside the bottom wall portion 17*c* at the positions facing with the electric wire through holes 21 respectively. The rubber plug chambers 19 are arranged in two rows in a vertical direction and in a plurality of rows in a lateral direction. In the peripheral wall portion 17*d* of the outer housing 17 surrounding the rubber plug chambers 19, are formed rubber plug exposing holes 17*e*, 17*f* and 17*g* at areas except the areas sealed with respect to the respective rubber plugs 18 (in a corner zone between the peripheral wall portion 17*d* and the bottom wall portion 17*c*). As shown in FIGS. 1 to 5, the rubber plug exposing holes 17*e*, 17*f*, 17*g* are formed so as to linearly pass through the peripheral wall portion 17*d* in a vertical direction, and the rubber plug exposing holes 17*e*, 17*f*, 17*g* thus vertically passing are so provided as to extend up to positions adjacent to the electric wire through holes 21 in the bottom wall portion 17*c*.

The rubber plugs 18 are adapted to be inserted into the rubber plug chambers 19 in a direction of A which is a direction wherein the inner housing 12 is fitted into the inner wall portion 17*a* of the outer housing 17 (in a fitting direction of the connector) by way of the spacer 28. Each of the rubber plugs 18 is integrally formed at its both ends 18*a* with extended portions 18*b* having a smaller diameter and extending up to an inner face of the bottom wall portion 17*c* of the outer housing 17 and an outer face of the bottom wall portion 28*c* of the spacer 28. An electric wire through hole 18*c* through which the electric wire 20 passes is formed at the center of the rubber plug 18 between the both ends 18*a*. The middle part of the rubber plug 18 is in a form of undulated cylinder so that the electric wire can be passed therethrough leaving no clearance. This waterproof connector 10 is substantially the same as the related waterproof connector 10" with respect to other structures, the same components will be denoted with the same reference numerals to omit a further explanation.

The waterproof connector 10 according to the embodiment is manufactured in a similar assembling manner to the related waterproof connector 10". However, as shown in FIGS. 1 and 3, there are respectively formed the rubber plug exposing holes 17*e*, 17*f* and 17*g* in the peripheral wall portion 17*d* of the outer housing 17 surrounding the rubber plug chambers 19 at the areas except the areas sealed with respect to the rubber plugs 18 in such a manner that the rubber plug exposing holes 17*e*, 17*f* and 17*g* linearly pass through the peripheral wall portion 17*d* in a vertical direction, and the rubber plug exposing holes 17*e*, 17*f*, 17*g* thus vertically passing are so provided as to extend up to the positions adjacent to the electric wire through holes 21 in the bottom wall portion 17*c*. Therefore, the presence of the rubber plugs 18 (lack of components) can be very easily confirmed from the exterior of the outer housing 17 through the vertically passing rubber plug exposing holes 17*e*, 17*f*, 17*g*, even in case where the rubber plug chambers 19 are arranged in two rows in a vertical direction and in a plurality of rows in a lateral direction in the bottom wall portion 17*c* of the outer housing 17. The assembling grade of the waterproof connector 10 can be thus improved.

Further, as shown in FIGS. 3 to 5, because water (water drops) B which has intruded into the rubber plug chambers 19 from the electric wire insertion inlets outside the electric wire through holes 21 in the outer housing 17 can be smoothly and reliably drained through the lowermost rubber plug exposing holes 17*g*, the water B will not stay in the rubber plug chambers 19. With this structure, the peripheral wall portion 17*d* and the bottom wall portion 17*c* of the outer housing 17 can be surely prevented from being broken when the water is frozen, and the reliability in the waterproofness by means of the rubber plugs 18 can be enhanced.

Further, as shown in FIG. 3, because the extended portion 18*b* is integrally formed at the one end 18*a* of the rubber plug 18 so as to extend up to the inner face of the bottom wall portion 17*c* of the outer housing 17, the extended portions 18*b* at the both ends 18*a* of the rubber plug 18 can be easily observed from the exterior of the outer housing 17 through the rubber plug exposing holes 17*e*, 17*f*, 17*g*. With this structure, the presence of the rubber plugs 18 (lack of components) can be easily confirmed, and the assembling grade of the waterproof connector 10 can be remarkably improved.

Figure 6:
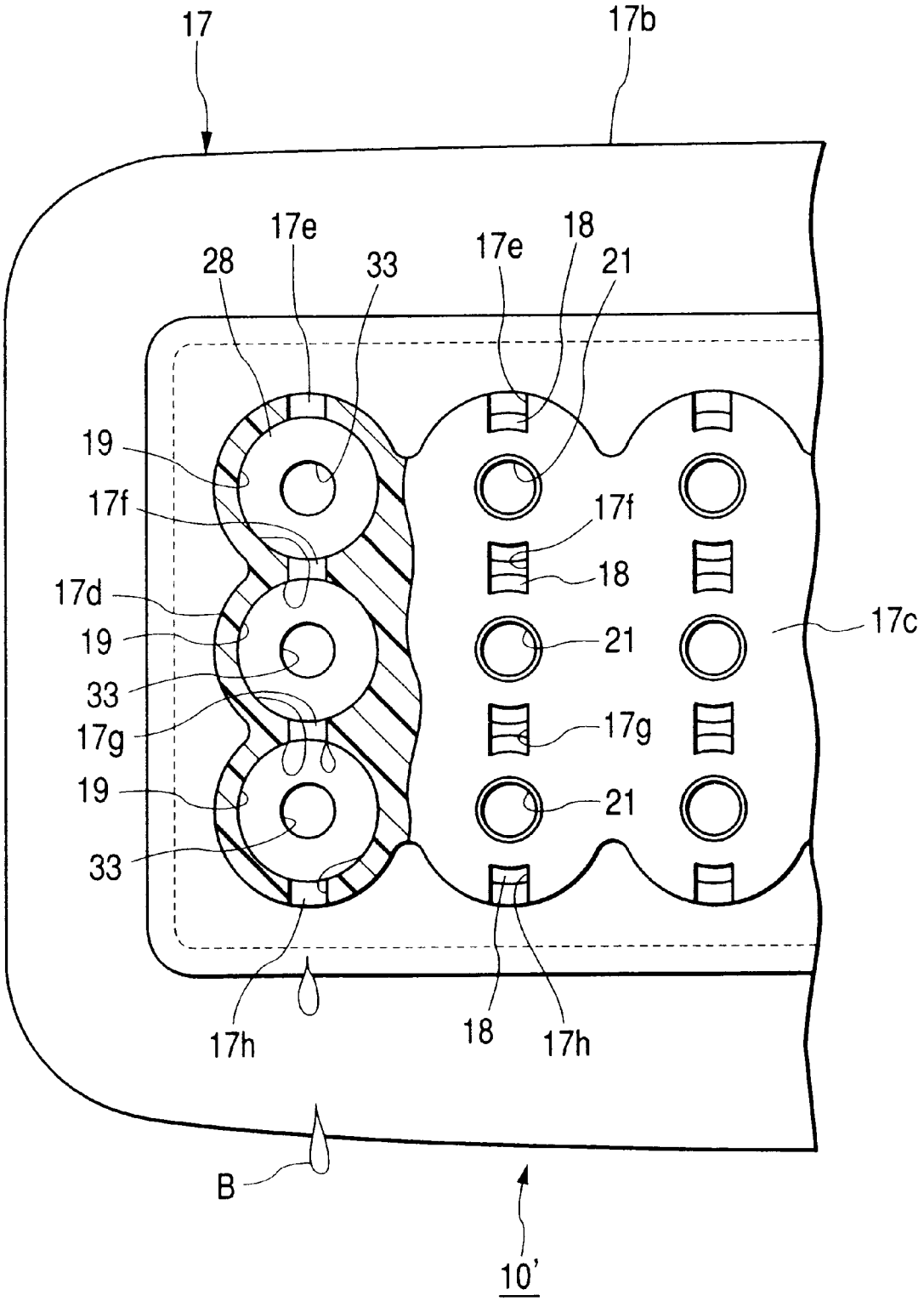
FIG. 6 is a fragmentary rear view partly shown in section of the essential part of a waterproof connector according to a second embodiment of the invention.
Figure 7:
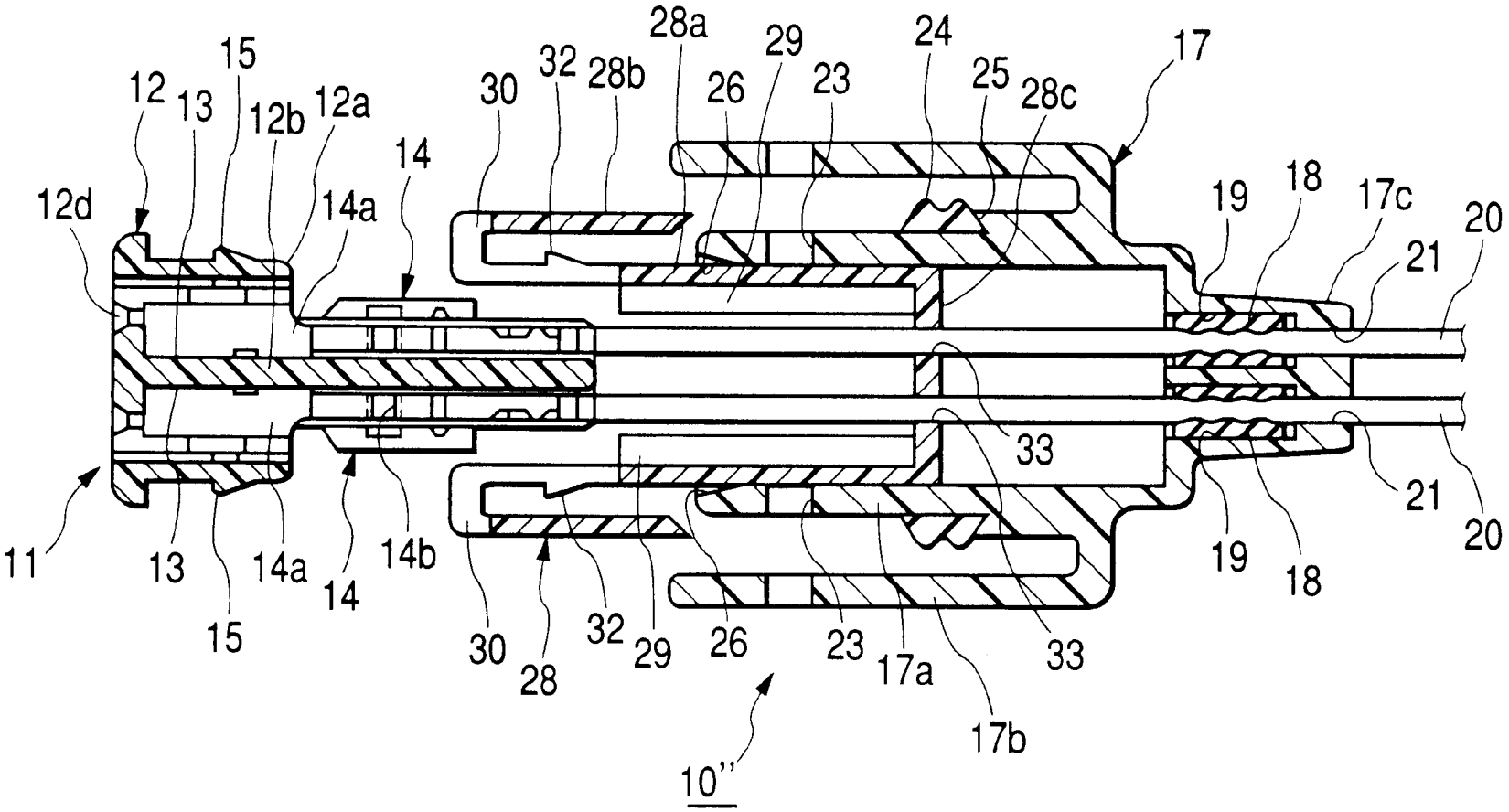
FIG. 7 is a sectional view showing a related waterproof connector in a state before assembled.
Figure 8:
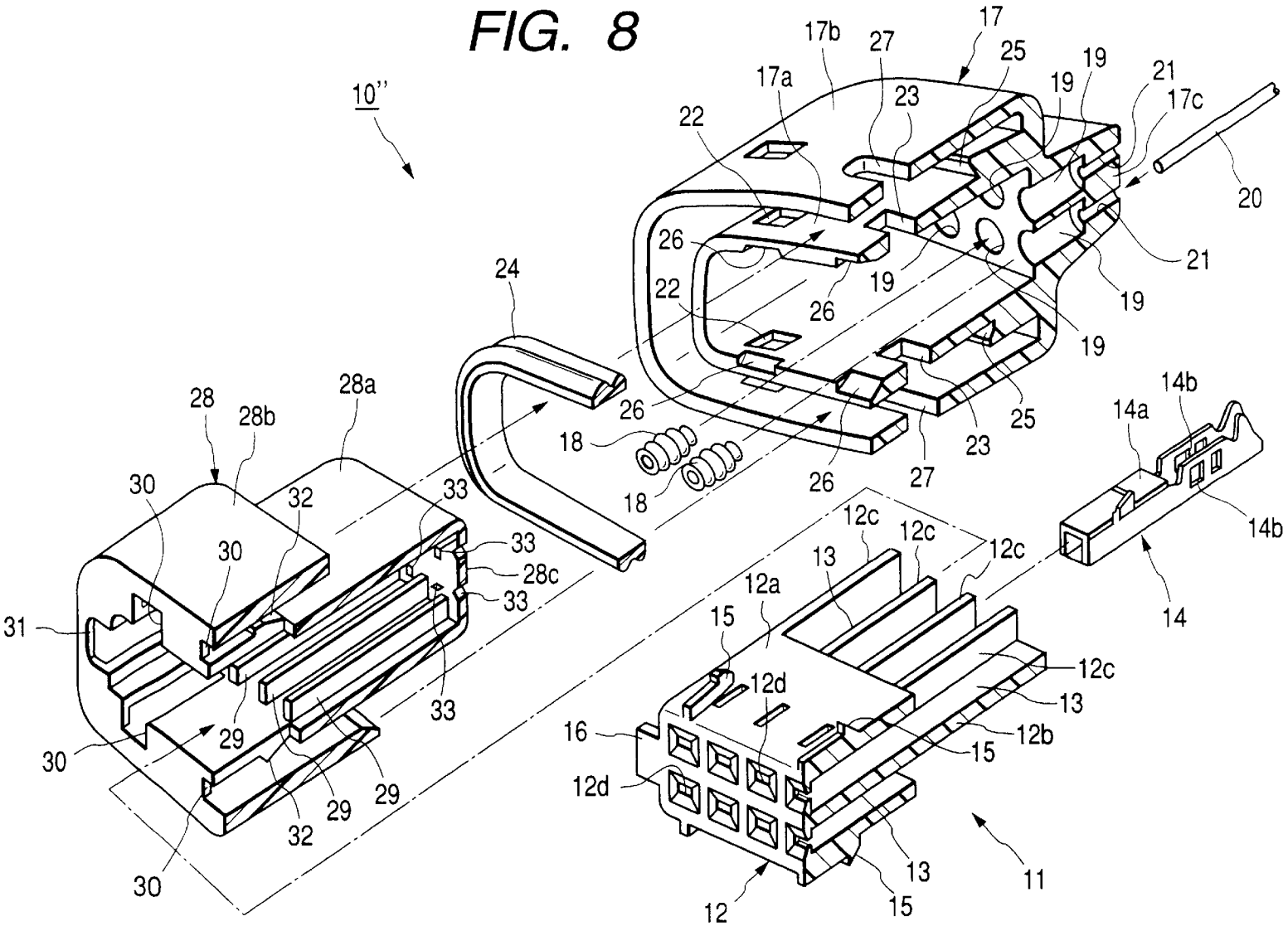
FIG. 8 is a perspective view of the related waterproof connector in a state before assembled partly shown in section.
Figure 9A:
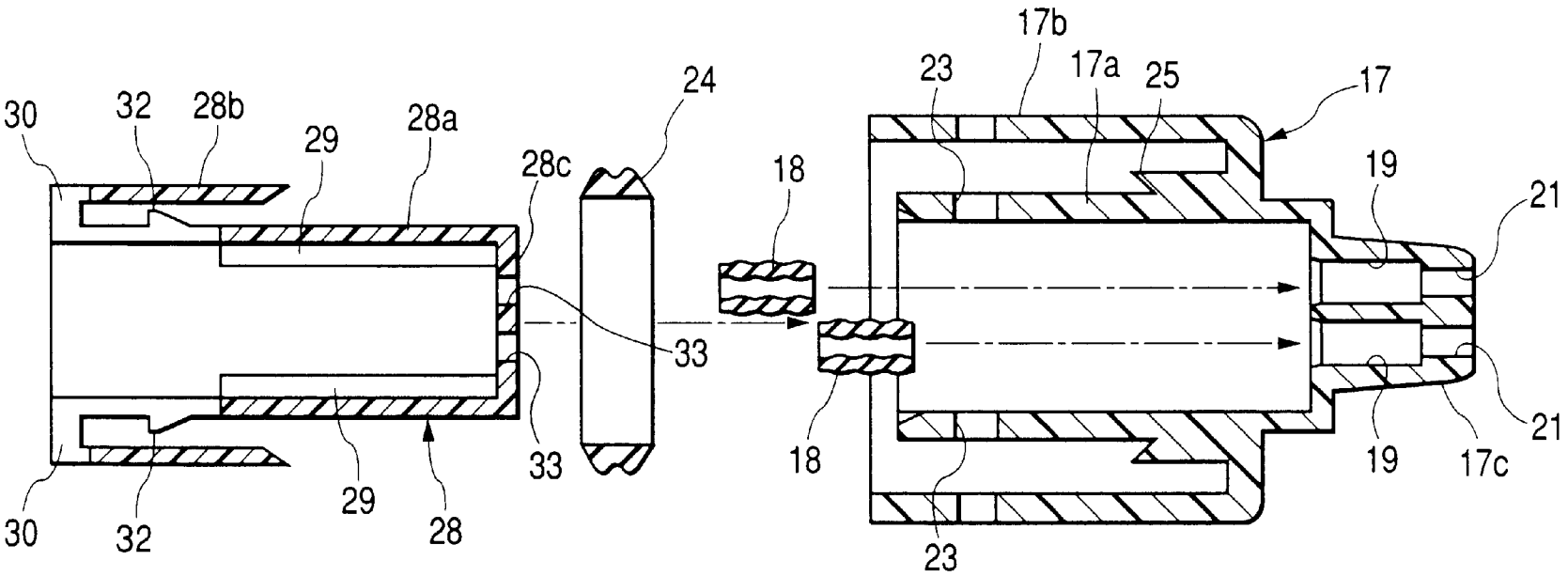
FIG. 9A is a sectional view showing the related waterproof connector in a state before assembled.
Figure 9B:
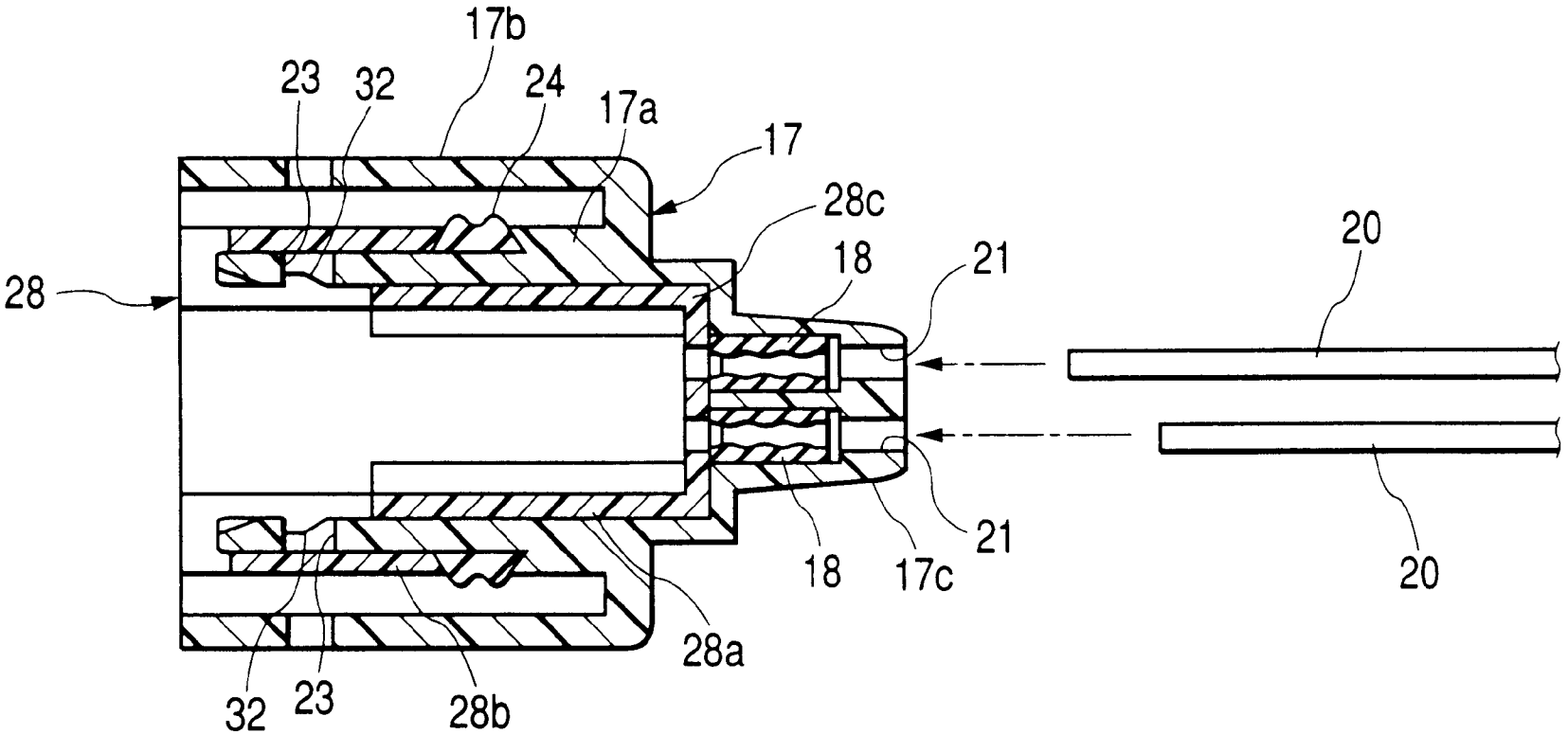
FIG. 9B is a sectional view showing the related waterproof connector in a state wherein a spacer has been fitted in an outer housing.
Figure 9C:
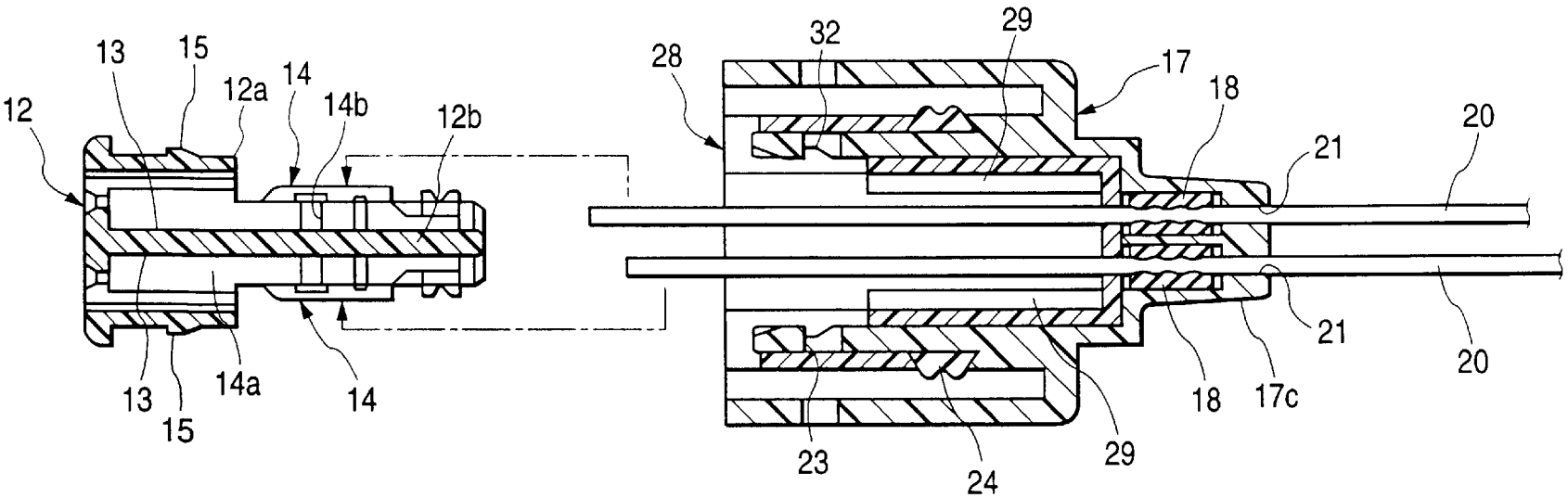
FIG. 9C is a sectional view of the related waterproof connector in a state wherein electric wires are passed through the outer housing and the spacer.
Figure 9D:
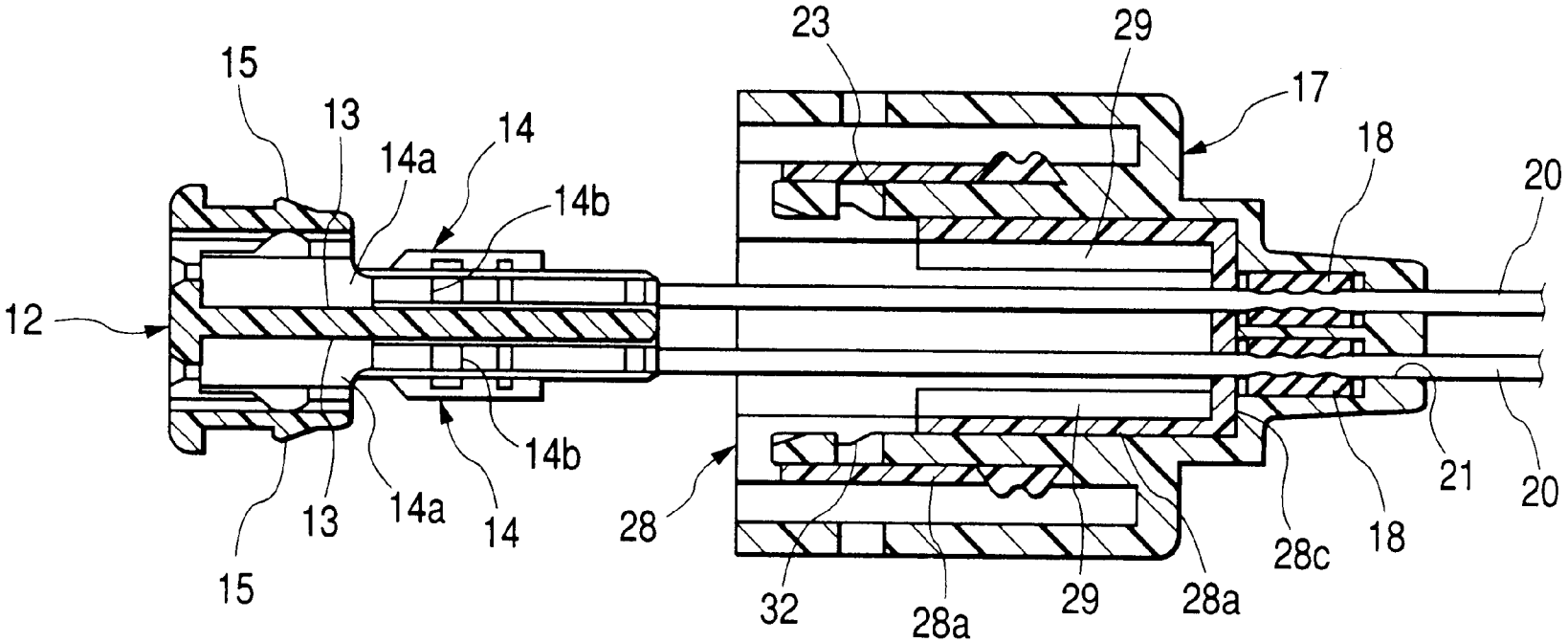
FIG. 9D is a sectional view of the related waterproof connector in a state wherein the electric wires are connected to terminals which are contained in the terminal chambers in an inner housing.
Figure 9E:
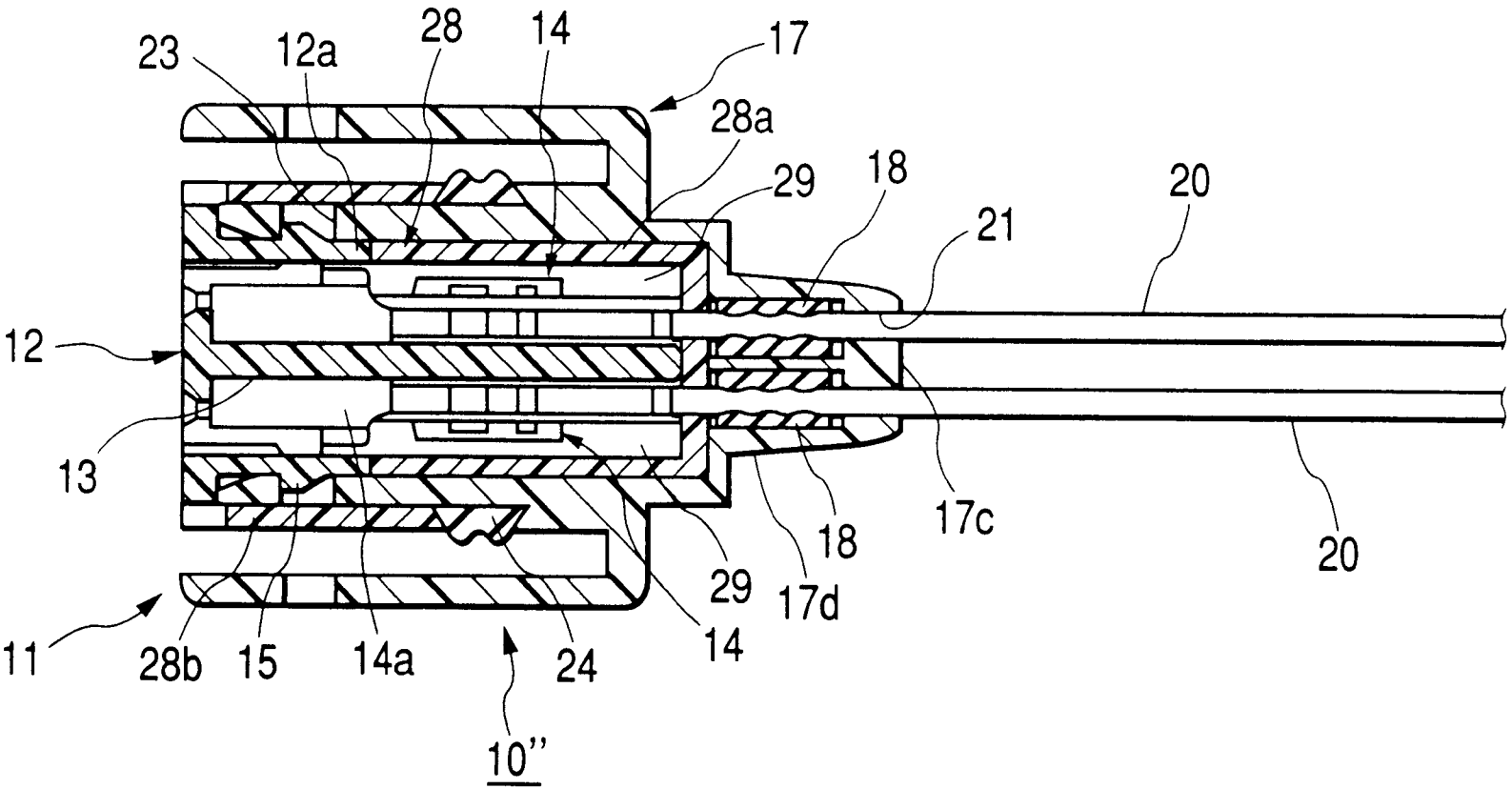
FIG. 9E is a sectional view showing the related waterproof connector in a completely assembled state.
Figure 10:
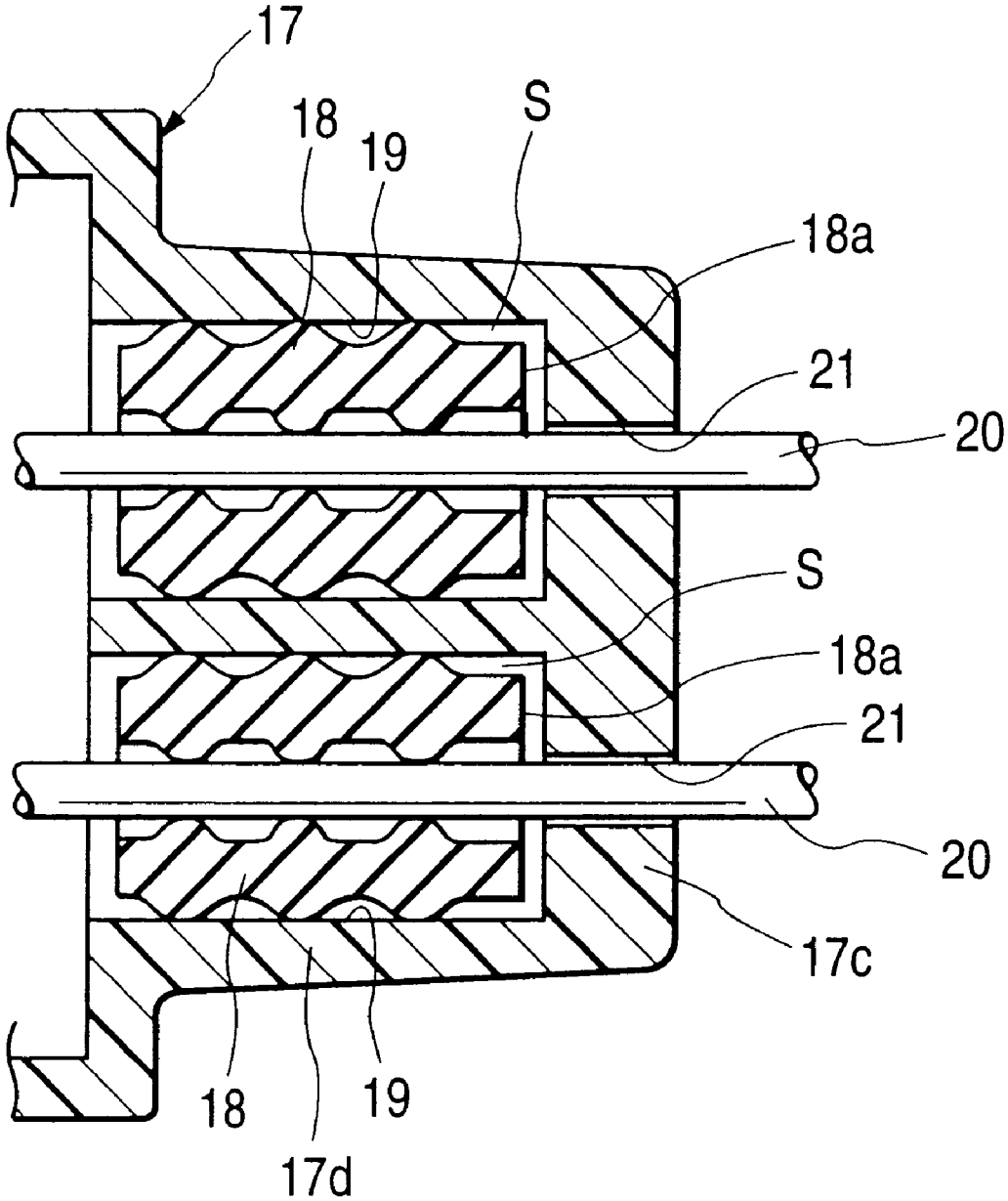
FIG. 10 is a sectional view showing the related waterproof connector in a state before the inner housing is fitted to the spacer which has been fitted into the outer housing.

FIG. 6 is a fragmentary rear view of a waterproof connector 10' according to a second embodiment of the invention partly shown in section. There are respectively formed the rubber plug exposing holes 17*e*, 17*f*, 17*g* and 17*h* in the peripheral wall portion 17*d* of the outer housing 17 surrounding the rubber plug chambers 19 at the areas except the areas sealed with respect to the rubber plugs 18. These rubber plug exposing holes 17*e*, 17, 17*g*, 17*h* are formed so as to linearly pass through the peripheral wall portion 17*d* in a vertical direction, and the rubber plug exposing holes 17*e*, 17*f*, 17*g*, 17*h* thus vertically passing are so provided as to extend up to the positions adjacent to the electric wire through holes 21 in the bottom wall portion 17*c*. This waterproof connector 10' is substantially the same as the waterproof connector 10 in the first embodiment with respect to other structures, the same components will be denoted with the same reference numerals to omit a further explanation.

This waterproof connector 10' attains similar effects to the above described waterproof connector 10. In short, the presence of the rubber plugs 18 (lack of components) can be very easily confirmed from the exterior of the outer housing 17 through the vertically passing rubber plug exposing holes 17*e*, 17*f*, 17*g*, 17*h* even in case where the rubber plug chambers 19 are arranged in three rows in a vertical direction and in a plurality of rows in a lateral direction in the bottom wall portion 17*c* of the outer housing 17. The assembling grade of the waterproof connector 10' can be thus improved.

In addition, because water (water drops) B which has intruded into the rubber plug chambers 19 from the electric wire insertion inlets outside the electric wire through holes 21 in the outer housing 17 can be smoothly and reliably drained through the lowermost rubber plug exposing holes 17*h*, the water B will not stay in the rubber plug chambers 19. With this structure, the peripheral wall portion 17*d* and the bottom wall portion 17*c* of the outer housing 17 can be surely prevented from being broken when the water is frozen, and the reliability in the waterproofness by means of the rubber plugs 18 can be enhanced.

In the above described embodiments, a pair of the rubber plug exposing holes are formed at upper and lower positions of the peripheral wall portion surrounding the rubber plug chambers, and an air is introduced through the upper rubber plug exposing holes in order to drain the water through the lower rubber plug exposing holes. However, the rubber plug exposing holes may be provided only at the upper side of the peripheral wall portion in case of confirming the presence of the rubber plugs (lack of components) only, and the rubber plug exposing holes may be provided only at the lower side of the peripheral wall portion in case of draining the water only. Moreover, the description has been made referring to the case where the electric wire is press-connected to the press-connected terminal, but the terminal is not limited to the press-connected type. It is apparent that the above described embodiments can be applied to the case where the electric wire is crimped to the crimp terminal.

What is claimed is:

1. A waterproof connector comprising:

a waterproof rubber plug having a through hole through which an electric wire is inserted to be connected to a terminal, said rubber plug having a sealing portion and a non-sealing portion;

a connector housing including a terminal chamber for accommodating the terminal and a wall portion having a through hole formed so as to oppose to the terminal chamber, through which the electric wire is inserted;

a recess for accommodating the rubber plug to thereby seal the electric wire and the terminal chamber by the sealing portion, the recess formed on an inner side face of the wall portion of the connector housing so as to communicate with the through hole of the wall portion, and;

a window hole formed on a part of the wall portion surrounding the recess so as to expose said non-sealing portion of the rubber plug, accommodated in the recess.

2. The waterproof connector as set forth in claim 1, wherein a diameter of one end portion of the rubber plug which faces inside of the connector housing is reduced to extend outside of the recess.

3. The waterproof connector as set forth in claim 1, wherein the window hole is formed so as to bore through the portion of the wall portion surrounding the recess in the vertical direction, and so as to extend up to a position adjacent to a portion where the through hole of the wall portion is provided.

4. The waterproof connector as set forth in claim 1, wherein the connector housing includes an inner housing having the terminal chamber and an outer housing having sidewalls for defining a chamber together with the wall portion, into which the inner housing is fitted.

5. The waterproof connector as set forth in claim 1, wherein a diameter of one end portion of the rubber plug which faces outside of the connector housing is reduced as the anti-sealing part.

6. A waterproof connector, comprising:

an inner housing of a general box shape, said inner housing containing one or more terminal accommodation chambers, said terminal accommodation chambers containing terminals for electrical wires;

an outer housing of a general box shape, said outer housing having one open end and one closed end, said open end sized to accept said inner housing, said closed end having one or more electrical passing holes, said passing holes corresponding to the number and position of said terminal accommodation chambers; said passing holes further comprising recessed portions containing rubber plugs for sealing said electrical wires, said rubber plugs having holes through their long axes to allow passage of said electric wires, said rubber plugs maintaining sealing contact with outer surface of said electrical wires and inner surface of said recess by a sealing portion, said rubber plug having said sealing portion and a non-sealing portion;

said outer housing further comprising a window hole formed on an outer surface of said closed end, said window hole formed to view said said non-sealing portion of said rubber plugs when said electrical wires are installed through said passing holes and said rubber plugs;

said electrical wires running from outside of said connector, through said passage holes, through said rubber plugs, and through said inner housing to attach to said terminals.

7. A waterproof connector, comprising:

electrical wires;

a connector portion having a first surface and a second surface;

said portion having one or more electrical passing holes from said first surface to said second surface, said passing holes firther comprising recessed portions containing rubber plugs for sealing said electrical wires, said rubber plugs having holes through their long axes to allow passage of said electrical wires, said rubber plugs maintaining sealing contact with outer surface of said electrical wires and inner surface of said recess by a sealing portion, said rubber plug having said sealing portion and a non-sealing portion;

said portion further comprising a window hole formed on an outer surface of said first surface, said window hole formed to view said non-sealing portion of said rubber plugs when said electrical wires are installed through said passing holes and said rubber plugs.

8. The waterproof connector as set forth in claim 1, wherein the window hole is always opened outwards.

* * * * *